US008590436B2

(12) United States Patent
Elia et al.

(10) Patent No.: US 8,590,436 B2
(45) Date of Patent: Nov. 26, 2013

(54) CUTTING MAT FOR A ROTARY ANVIL

(75) Inventors: John R. Elia, Arden, NC (US); Jerry Shelton, Fairview, NC (US); Ronnie E. Bryson, Sylva, NC (US)

(73) Assignee: Day International, Inc., Plymouth, MI (US)

( * ) Notice: Subject to any disclaimer, the term of this patent is extended or adjusted under 35 U.S.C. 154(b) by 1652 days.

(21) Appl. No.: 11/328,346

(22) Filed: Jan. 9, 2006

(65) Prior Publication Data

US 2006/0107807 A1 May 25, 2006

Related U.S. Application Data

(62) Division of application No. 10/442,700, filed on May 21, 2003, now Pat. No. 7,007,581.

(51) Int. Cl.
*B26D 7/20* (2006.01)

(52) U.S. Cl.
USPC ..... 83/659; 83/347; 83/698.42

(58) Field of Classification Search
USPC ..... 83/659, 347, 698.31, 658, 698.42, 83/698.41; 492/45, 40, 48, 56
See application file for complete search history.

(56) References Cited

U.S. PATENT DOCUMENTS

| | | | | |
|---|---|---|---|---|
| 229,513 | A | | 7/1880 | Allen |
| 1,912,069 | A | | 5/1933 | Doermann |
| 2,712,205 | A | | 7/1955 | Valette |
| 3,045,323 | A | * | 7/1962 | Willingham, Jr. ..... 38/63 |
| 3,270,607 | A | | 9/1966 | Oesterreicher |
| 3,522,754 | A | | 8/1970 | Sauer |
| 3,577,822 | A | | 5/1971 | Sauer et al. |
| 3,739,675 | A | | 6/1973 | Duckett et al. |
| 3,765,329 | A | | 10/1973 | Kirkpatrick et al. |
| 3,880,037 | A | | 4/1975 | Duckett et al. |
| 3,882,750 | A | | 5/1975 | Duckett et al. |
| 3,885,486 | A | | 5/1975 | Kirkpatrick et al. |
| RE28,581 | E | * | 10/1975 | Koch ..... 492/38 |
| 4,031,600 | A | | 6/1977 | Whigham |
| 4,073,207 | A | | 2/1978 | Kirkpatrick |
| 4,075,918 | A | | 2/1978 | Sauer |
| 4,191,076 | A | | 3/1980 | Bollmer et al. |
| 4,240,192 | A | | 12/1980 | Davis |
| 4,240,312 | A | | 12/1980 | Ward, Sr. |
| 4,287,799 | A | | 9/1981 | Fujita et al. |

(Continued)

FOREIGN PATENT DOCUMENTS

| | | |
|---|---|---|
| GB | 2 288 563 | 10/1995 |
| JP | 358006719 | 1/1983 |
| WO | WO 02/085583 A1 | 10/2002 |

*Primary Examiner* — Omar Flores Sanchez
(74) *Attorney, Agent, or Firm* — Dinsmore & Shohl LLP

(57) ABSTRACT

A rotary anvil is outfitted with pins protruding from the base of an axially extending channel along the surface of the anvil. A cutting mat having a generally elongate body includes first and second locking members projecting from opposite axial ends thereof. The cutting mat is installed on the anvil such that the first and second locking members are positioned within the channel over one of the pins. The cutting mat may include a foot extending from the first locking member that includes a pin receptacle that seats down over the pin. Alternatively, a lockup device may be provided to temporarily secure the cutting mat to the rotary anvil. The lockup device includes a pin receptacle on the bottom surface thereof adapted to seat down over the pin. The first and second locking members of the cutting mat are then installed into the channel in cooperation with the lockup device.

9 Claims, 4 Drawing Sheets

(56) References Cited

U.S. PATENT DOCUMENTS

| | | | | |
|---|---|---|---|---|
| 4,337,700 | A * | 7/1982 | Etchell et al. | 101/415.1 |
| 4,378,737 | A | 4/1983 | Kirkpatrick | |
| 4,791,846 | A | 12/1988 | Kirkpatrick | |
| 4,848,204 | A | 7/1989 | O'Connor et al. | |
| 4,867,024 | A | 9/1989 | Cho et al. | |
| 4,982,639 | A | 1/1991 | Kirkpatrick | |
| 5,076,128 | A | 12/1991 | O'Connor et al. | |
| 5,078,535 | A | 1/1992 | Kirkpatrick | |
| 5,219,352 | A | 6/1993 | Atkinson | |
| 5,720,212 | A | 2/1998 | Kirkpatrick | |
| 5,758,560 | A | 6/1998 | Fiscus | |
| 5,906,149 | A | 5/1999 | Montenegro Criado | |
| 5,916,346 | A | 6/1999 | Neal | |
| 6,073,530 | A | 6/2000 | Dombkowski | |
| 6,116,135 | A | 9/2000 | Wagner | |
| 6,135,002 | A | 10/2000 | Neal | |
| 6,435,069 | B1 | 8/2002 | Kirkpatrick et al. | |
| 6,539,629 | B2 | 4/2003 | Lai | |
| 6,629,482 | B2 | 10/2003 | Elia et al. | |
| 6,668,694 | B2 | 12/2003 | Neal et al. | |
| 6,698,326 | B2 | 3/2004 | Elia et al. | |
| 6,785,963 | B2 | 9/2004 | Kirkpatrick et al. | |
| 6,820,529 | B2 | 11/2004 | Elia et al. | |
| 2001/0027709 | A1 | 10/2001 | Elia et al. | |
| 2001/0029812 | A1 | 10/2001 | Kirkpatrick et al. | |
| 2002/0189419 | A1 | 12/2002 | Elia et al. | |

* cited by examiner

CUTTING MAT FOR A ROTARY ANVIL

CROSS REFERENCE TO RELATED APPLICATIONS

This application is a division of U.S. patent application Ser. No. 10/442,700, filed May 21, 2003.

BACKGROUND OF THE INVENTION

The present invention relates in general to flexible, annular cutting mats, and in particular, to boltless cutting mats for use with rotary anvils.

Rotary die cutting machines are utilized to perform cutting operations in numerous industries. For example, the corrugated industry utilizes rotary die cutting machines to cut and score corrugated paperboard materials for constructing packaging products such as boxes and shipping containers. Basically, these machines pass a continuously moving workpiece through the nip of a cutting roller and a rotary anvil. The roller includes blades that project from the surface thereof, to provide the desired cutting actions to the workpiece. The rotary anvil includes several cutting mats aligned axially about the anvil surface to support the workpiece at the point where the work material is scored by the blades of the roller. The cutting mats serve as a backstop allowing the blades to be urged against the workpiece without damaging the blades themselves.

During use, the blades on the roller penetrate the cutting mats. This leads to eventual fatigue and wear of the cutting mats, requiring that the cutting mats be periodically replaced. In an effort to more evenly distribute the wear across the cutting mats, rotary anvils are known to oscillate in a lateral direction. The oscillatory action assists in preventing the cutting blades from repeatedly striking the cutting mats in the same location thus extending cutting mat life. However, even with an oscillating anvil, it is unlikely that all of the cutting mats will wear evenly and cutting mats will still have to be periodically replaced. For example, at times, rotary die cutting machines operate on a workpiece such that the full width of the rotary die cutting machine is not used. Under this circumstance, certain cutting mats experience most of the wear. As the cutting mats wear, the quality of the cutting operation deteriorates.

Rotating the relative positions of the cutting mats on the rotary anvil such that the cutting mats wear more evenly may prolong the serviceable life of cutting mats. However, repositioning the cutting mats causes downtime because the rotary die cutting machine cannot be in operation when changing or adjusting the cutting mats. Because of downtime, the industry tendency is to prolong the time between cutting mat changeovers. This can lead to a greater possibility of poor quality cuts.

A number of factors other than cutting mat wear also affect the performance of cutting operations. For example, a rotary anvil typically includes an axially extending channel along the surface thereof. The cutting mats are provided as blankets having flanges along opposite ends of the mat. The cutting mat is wrapped about the cylinder of the rotary anvil and secured thereto by installing the flanged ends into the axial channel. The cutting mats thus create a seam that extends axially along the anvil.

Certain rotary anvils, especially those anvils that have seen extensive service life, can exhibit non-uniform wear, such as beveling of the channel edges. Also, in some operating environments, the dimensions of the channel have been intentionally modified for user specific purposes. Likewise, not all cylinders are made with identical channel dimensions. These inconsistencies in channel dimension can affect how securely the cutting mat is secured to the anvil and thus affect cutting mat performance. For example, diagonally oriented knife blades can tend to act as a wedge when striking at or near the seam between the ends of the cutting mat. Moreover, the oscillatory action of the anvil can exert lateral forces on the cutting mat enhancing the wedge effect. Should the cutting mat skew or shift, for example, because of an imprecise fit with the channel of the anvil, a gap may be created. This can cause damage to the knife blade should the blade strike the anvil in the gap.

Further, the orientation of the cutting blades, especially when positioned axially, can at times, strike the cutting mats along the seam. As a consequence, a cutting blade may slip through the seam possibly damaging the blade. For example, if a cutting blade is positioned along an axial dimension of the roller, the blade can strike the rotary anvil along the axial seam defined between opposite ends of one or more cutting mats. A die cutting machine must exert increased pressure to achieve a satisfactory cut when the blades of the roller slip between the seams defined by or between cutting mats. This increased pressure may shorten the life potential of the cutting mat, may lead to damage of the blade, and may require more frequent maintenance of the roller.

SUMMARY OF THE INVENTION

The present invention overcomes the disadvantages of previously known cutting mats by providing cutting mats and lockup devices that are installed onto a rotary anvil without bolts, yet provide a positive temporary connection thereto.

Initially, a pin is installed into a channel extending along the surface of a rotary anvil. Once installed, the pin may optionally remain a permanent or semi-permanent component of the rotary anvil. A cutting mat having a generally elongate body includes first and second locking members projecting from opposite axial ends thereof. The cutting mat is installed onto the rotary anvil such that the first and second locking members are positioned within the channel of the anvil and are fitted over the pin. As such, the pin provides a physical link between the channel of the rotary anvil and the cutting mat.

According to an embodiment of the present invention, the cutting mat includes a foot integral with the cutting mat body extending from the first locking member. The foot includes a pin receptacle dimensioned such that when the cutting mat is installed onto the rotary anvil, the foot rests on the floor of the channel and the pin receptacle seats down over the pin.

According to another embodiment of the present invention, a lockup device is provided to temporarily secure the cutting mat to the rotary anvil. The lockup device includes a pin receptacle on the bottom surface of a base portion thereof. The lockup device is positioned within the channel such that the pin receptacle seats down over the pin. The first and second locking members of the cutting mat are installed into the channel in cooperation with the lockup device.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals, and in which.

DETAILED DESCRIPTION OF THE PREFERRED EMBODIMENTS

Figure 1:
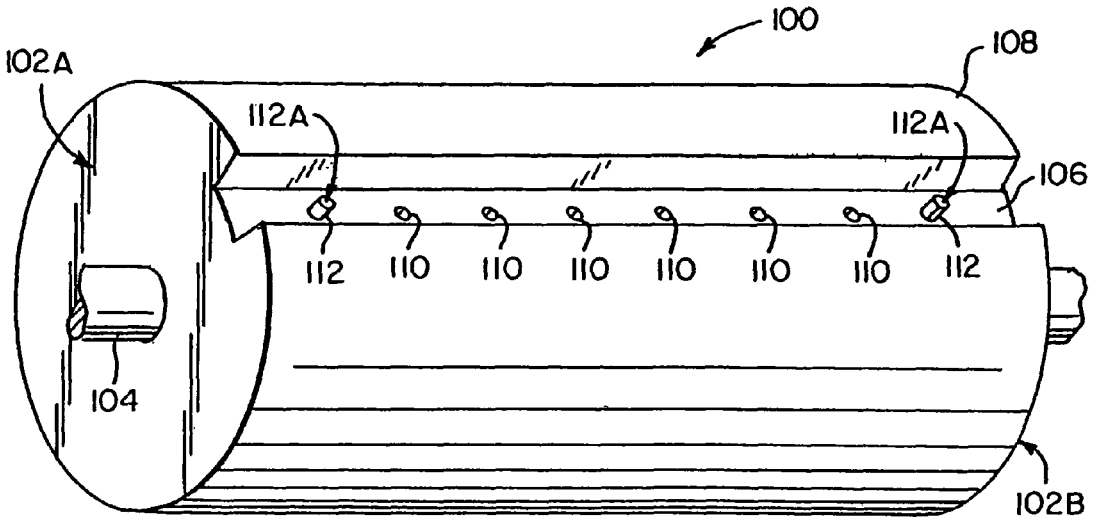
FIG. 1 is a perspective view of a typical rotary anvil having a cylindrical portion and an axial channel extending along the surface thereof.

In the following detailed description of the preferred embodiments, reference is made to the accompanying drawings that form a part hereof, and in which are shown by way of illustration, and not by way of limitation, specific preferred embodiments in which the invention may be practiced. It will be appreciated that these are diagrammatic figures, and that the illustrated embodiments are not shown to scale. Further, like structure in the drawings is indicated with like reference numerals throughout.

Referring to FIG. 1, a typical rotary anvil 100 comprises first and second end faces 102A, 102B configured to receive a shaft 104 therethrough. The shaft 104 supports the rotary anvil 100 for rotation on associated support bearings (not shown) as is known in the art. The rotary anvil 100 also comprises a channel 106 disposed axially along a surface 108 thereof. The channel 106 provides a lockup area for securing cutting mats to the surface 108 of the rotary anvil 100. The rotary anvil 100 may also include a plurality of holes 110 axially spaced along the floor of the channel 106.

According to an embodiment of the present invention, at least one pin 112 is provided. Each pin is installed into a respective one of the holes 110 in the channel 106. Once installed on the rotary anvil 100, the pin 112 may optionally remain as a permanent or semi-permanent component of the rotary anvil 100. The pin is typically installed in the channel 106 such that an uppermost extent of the pin 112A is recessed within the channel 106 and below the surface 108 of the anvil 100. For example, the channel 106 of the rotary anvil 100 is typically 0.530 inches (1.35 centimeters) to 0.570 inches (1.48 centimeters) deep. Each pin 112 is thus installed into a select one of the holes 110 such that the pin 112 extends radially out a distance less than the depth of the channel 106, such as approximately 3/16 of an inch (0.47 centimeters) to 1/4 of an inch (0.64 centimeters) from the floor of the channel 106. While the pins 112, such as a setscrews, in FIG. 1 are illustrated with a circular cross-section, any other cross-sections and shapes can be used.

Figure 2:
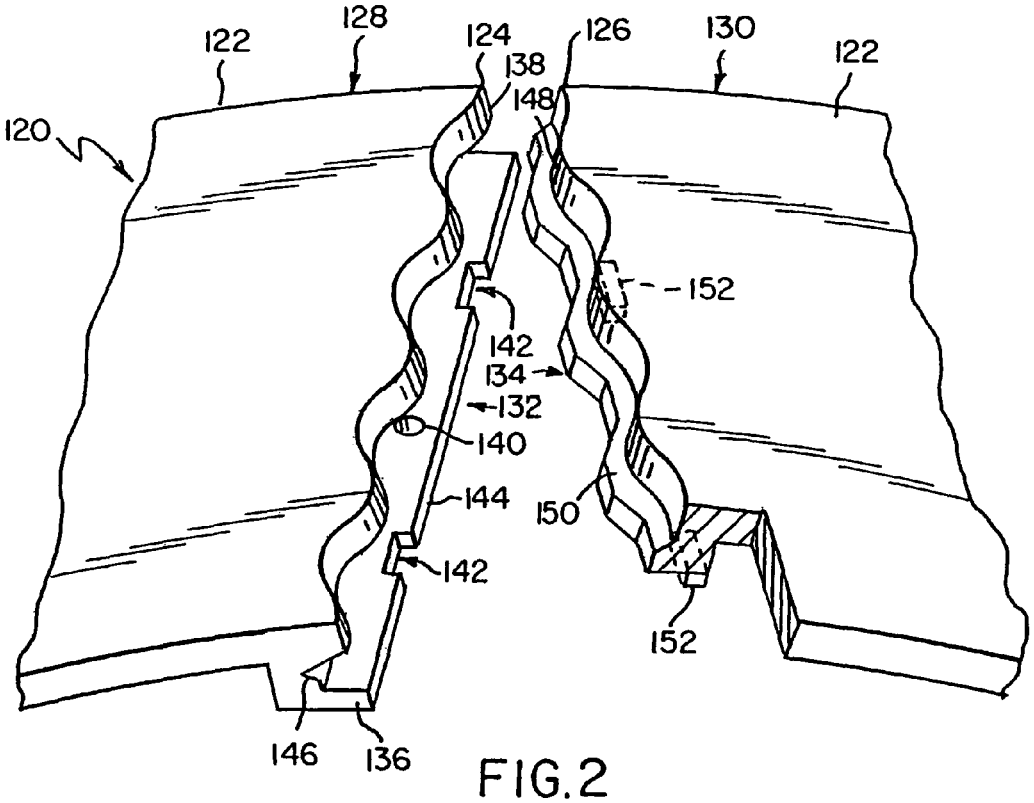
FIG. 2 is a fragmentary perspective view showing each axial end of a cutting mat according to an embodiment of the present invention.

Referring to FIG. 2, a cutting mat according to an embodiment of the present invention is illustrated. The cutting mat 120 comprises a generally elongate body 122 and includes opposing nonlinear and complimentary first and second axial edges 124, 126. By complimentary, it is meant that that the cutting mat 120 is wrappable into a generally cylindrical shape such that the first and second axial edges 124, 126 abut each other in mating relationship defining a seam therebetween.

According to an embodiment of the present invention, the axial seam defines a nonlinear shape when measured across the entire axial length of the cutting mat 120. By nonlinear shape, it is meant that the first and second axial edges 124, 126 of the cutting mat 120 do not follow a single straight path across their entire axial length. For example, as illustrated, the first and second axial edges 124, 126 define a complementary, generally serpentine shape such that when the first and second axial edges are mated together, a generally serpentine seam is defined therebetween. For example, the cutting mat 120 may have an axial length of generally 10 inches (25.4 centimeters). For a one inch (2.54 centimeters) wide channel, a suitable pattern for the first and second axial edges 124, 126 can comprise a serpentine or sinusoidal pattern having a period of approximately two inches (5.08 centimeters), and an amplitude of approximately one eighth of an inch (0.3175 centimeters). While a generally serpentine configuration is shown, other nonlinear configurations are possible including for example, saw tooth, serrations, undulations, sinusoids, zigzags, bends and curvilinear patterns. Moreover, the pattern need not be a repeating pattern.

The seam formed by the abutting first and second axial edges will not remain parallel to a cutting blade (not shown in the Figures) sufficient to allow the cutting blade to slip through the seam. Further, a nonlinear seam allows for better alignment of adjacent cutting mats 120 and improved stability of the cutting mat.

A first end portion 128 of the cutting mat 120 is defined by that part of the cutting mat 120 proximate the first axial edge 124. Likewise, a second end portion 130 of the cutting mat 120 is defined by that part of the cutting mat 120 proximate the second axial edge 126. The first end portion 128 includes a first locking member 132 defined by a first flanged portion extending generally normal to the cutting mat body 122. Similarly, the second end portion 130 includes a second locking member 134 defined by a second flanged portion extending generally normal to the cutting mat body 122.

The first locking member 132 includes a foot 136 that projects outwardly from the first axial edge 124 and extends substantially the length of axial edge 124. A first face 138 extends between the foot 136 and the body 122 of the cutting mat 120. The foot 136 includes a pin receptacle 140 that is arranged to position over the pin 112 projecting from the channel 106 of the rotary anvil 100 as shown in FIG. 1. The pin receptacle 140 can be formed for example, as a cavity in a bottom surface of the foot 136 or as a through aperture in the foot 136. Moreover, the pin receptacle 140 can be oblong in shape so as to be oversized with respect to the pin 112, or the pin receptacle 140 may be sized to correspond generally to the dimensions of the pin. For example, the pin receptacle 140 may comprise a cross-section similar to the cross-section of the pin 112, dimensioned so as to be slightly larger with respect thereto. The foot 136 may also optionally include one or more slots 142 therein. As shown, the two slots 142 are provided adjacent to an axial edge 144 of the foot 136, however, the slots 142 can be positioned anywhere. Also, while the slots 142 are shown extending completely through the foot 136, the slots 142 may also be formed as cavities, indents or cut out portions of the foot 136.

At least a portion of the first face 138 is nonlinear in the axial direction and may, for example, generally follow the nonlinear path of the first axial edge 124. As such, the first face 138 has a surface profile that is contoured. The first face 138 need not maintain a consistent or uniform relief between the first axial edge 124 and the foot 136. Protrusions, recessed portions and other surface features may be provided. For example, a locking recess 146 extends generally axially along at least a portion of the first face 138. The locking recess 146 may optionally follow the contour of the first face 138, or may take on other configurations.

The second locking member 134 includes a second face 148. At least a portion of the second face 148 is nonlinear in the axial direction and has a surface profile that is contoured and is generally complimentary to the first face 138. For example, at least a portion of the second face 148 may generally follow the contour of the second axial edge 126. However, the second face 148 need not maintain a consistent or uniform relief between the second axial edge 126 and the lower most extent of the second locking member 134. Rather, protrusions, recessed portions and other surface features may be provided. For example, the second locking member 134 includes a locking projection 150 that projects generally axially along at least a portion of the second face 148. The locking projection 150 is dimensioned to correspond with the locking recess 146 on the first face 138. The locking projection 150 may optionally generally follow the nonlinear contour of the second axial edge 126, or take on other configurations. If the foot 136 of the first locking member 132 includes slots 142 therein, then the second locking member 134 further includes corresponding posts 152 projecting therefrom.

The cutting mat is constructed using any number of materials and processing techniques. For example, the cutting mats 114 may be fabricated from any suitable natural or synthetic polymeric material including for example, polyurethane, polyvinyl chloride and chlorinated butyl rubber. Further, stabilizing, strengthening and curing additives may be used. The cutting mats 114 may also optionally include a backing material or other reinforcing layers (not shown) such as woven or non-woven fabric, or thin flexible sheet material such as sheet metal. The first and second locking members 132, 134 are preferably formed integral with the cutting mat body 122 resulting in a one-piece construction. Under such an arrangement, there are no metal, frames, or other materials exposed on the surfaces of the first and second locking members 132, 134.

Moreover, the cutting mat, including the axial and circumferential edges may be nonlinear and incorporate the features set out in U.S. patent application Ser. No. 09/881,943 filed Jun. 15, 2001, entitled "BOLTLESS CUTTING MAT LOCKUP" and U.S. patent application Ser. No. 10/161,416 filed Jun. 3, 2002, entitled "CUTTING MAT" the disclosures of which are hereby incorporated by reference.

Figure 3:
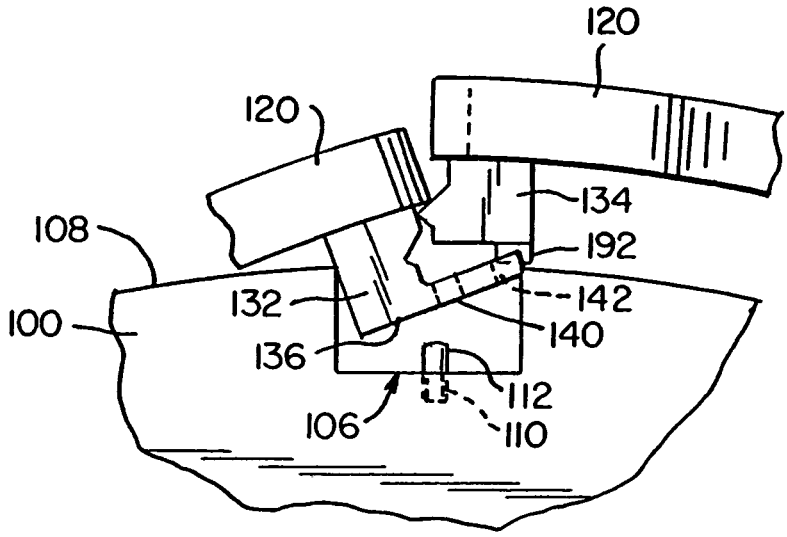
FIG. 3 is a fragmentary cross-sectional side view illustrating the cutting mat of FIG. 2 being installed on a typical rotary anvil.

Referring to FIG. 3, during installation, the cutting mat 120 is wrapped about the rotary anvil 100. The first locking member 132 is inserted into the channel 106 of the rotary anvil 100. As shown, the foot 136 is not placed directly against the floor of the channel 106. Rather, the heel of the foot 136 is lowered into the channel 106, and the foot 136 is angled upward towards the uppermost extent of the channel 106 opposite the heel. If installing over a pin 112, the cutting mat 120 is axially positioned on the rotary anvil 100 such that the pin receptacle 140 is generally aligned with the pin 112. The second locking member 134 is also aligned generally over the channel 106. Pressing or lightly tapping the cutting mat 120 with a mallet, hand or other blunt object then inserts the cutting mat 120 down into the channel 106. Under this arrangement, the first and second locking members 132, 134 are seated into the channel 106 generally concomitantly. It should be observed that in the particular embodiment described with reference to FIG. 3, the pin 112 should preferably extend from the channel 106 no more than the height of the foot 136. This is because the second locking member 134 rests over the foot 136 of the first locking member 132 when the cutting mat 120 is installed on the anvil.

Figure 4:
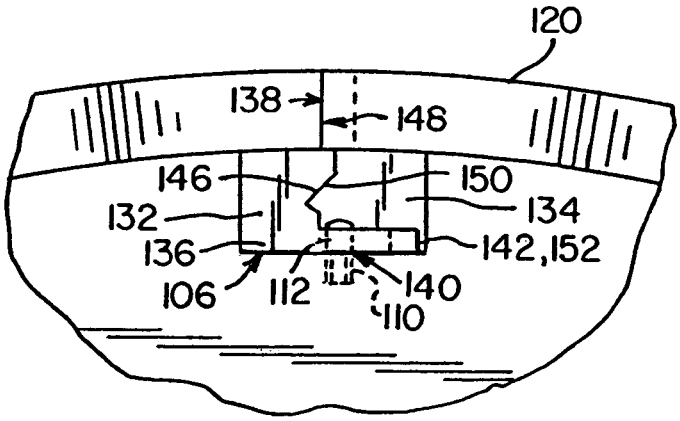
FIG. 4 is a fragmentary cross-sectional side view of the cutting mat of FIG. 2 installed in a typical rotary anvil.

Referring to FIG. 4, when the first and second locking members 132, 134 are properly seated in the channel 106, the foot 136 rests on the floor of the channel 106 and need not occupy the entire width of the channel 106. For example, as shown, the foot 136 has a length that is slightly less than the channel width. The pin receptacle 140 of the foot 136 is seated down over top of the pin 112. The first and second faces 138, 148 abut in mating relationship such that the locking projection 150 is received by the locking recess 146. Further, the posts 152 are seated down into the slots 142. The cutting mat 120 is releasably secured to the rotary anvil 100 by frictional forces. However, compressive forces are not necessary to hold the cutting mat to the rotary anvil. For example, the pin 112 may be thought of as providing a physical link to the foot 136 of the first locking member 132. The second locking member 134 is held within the channel 106 by contact with the first locking member 132.

This arrangement ensures that the ends of the cutting mat 120 are secured to the rotary anvil 100, and are prevented from lifting or otherwise moving radially from the rotary anvil 100. The engagement of the pin 112 by the pin receptacle 140, the contoured surface profile of the first and second faces 138, 148, and the fitting of the posts 152 into the slots 142 all serve to prevent lateral (axial) shifting, skewing or other movement of the cutting mat 120. It shall be observed that the posts 152 and corresponding slots 142 may not be necessary depending upon the ability of the contour of the first and second faces 138, 148 and the pin 112 and pin receptacle 140 to provide sufficient lateral stability.

Once installed, the cutting mat 120 may be removed using any number of means. For example, a standard screwdriver or specially designed tool may be inserted between the cutting mat 120 and the channel 106. Using an insert and lift motion similar to that action of opening a can, the first and second locking members 132, 134 of the cutting mat 120 will come out of the channel.

Figure 5:
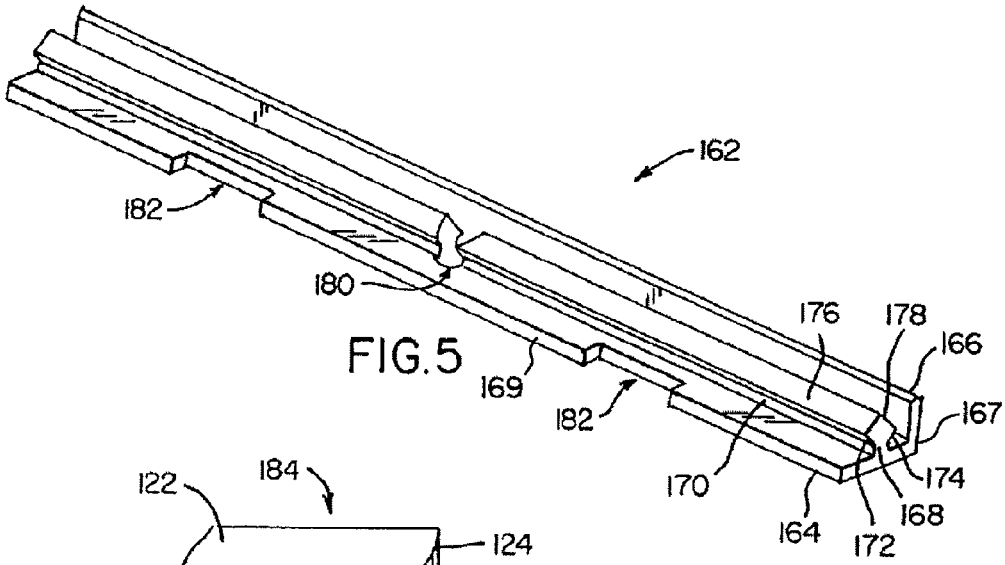
FIG. 5 is a perspective view of a lockup device for securing a cutting mat to a rotary anvil according to an embodiment of the present invention.

Referring to FIG. 5, a cutting mat lockup device is illustrated. Briefly, the lockup device 162 comprises a base 164, a sidewall 166 that projects from the base 164 disposed along a first axial edge 167 thereof, and a locking wedge 168 that projects from the base 164, extending generally parallel to the sidewall 166. The locking wedge 168 includes a leg portion 170 extending from the base 164 substantially normal thereto. First and second locking surfaces 172, 174 extend outwardly from opposite sides of the leg portion 170. First and second guide surfaces 176, 178 extend from their respective first and second locking surfaces 172, 174 and join together defining a substantially inverted "V" shape. The lockup device 162 is preferably constructed from a metal such as aluminum, however other suitable materials may be used such as plastics or composite materials.

The lockup device 162 includes a pin receptacle 180 that is dimensioned to position over a pin projecting from the channel of a rotary anvil as described more fully herein. The pin receptacle may be formed for example, either as a cavity in a bottom surface of the base 164, as a cut-out portion in the lockup device 162, or as a through aperture. As shown, the pin receptacle is a through aperture that extends through the base 164 and locking wedge 168. The lockup device 162 further optionally includes one or more slots 182 therein. The slots 182 are illustrated adjacent to second axial edge 169 of the base 164, but may be positioned anywhere on the lockup device 164. Also, although the slots 182 are shown extending entirely through the base 164, the slots 182 may be formed as cavities or cut out portions. The lockup device 162 may further include any of the features described in U.S. Pat. No. 6,698,326, entitled "LOCK-UP SYSTEM FOR CUTTING MAT" which is herein incorporated by reference in its entirety.

Figure 6:
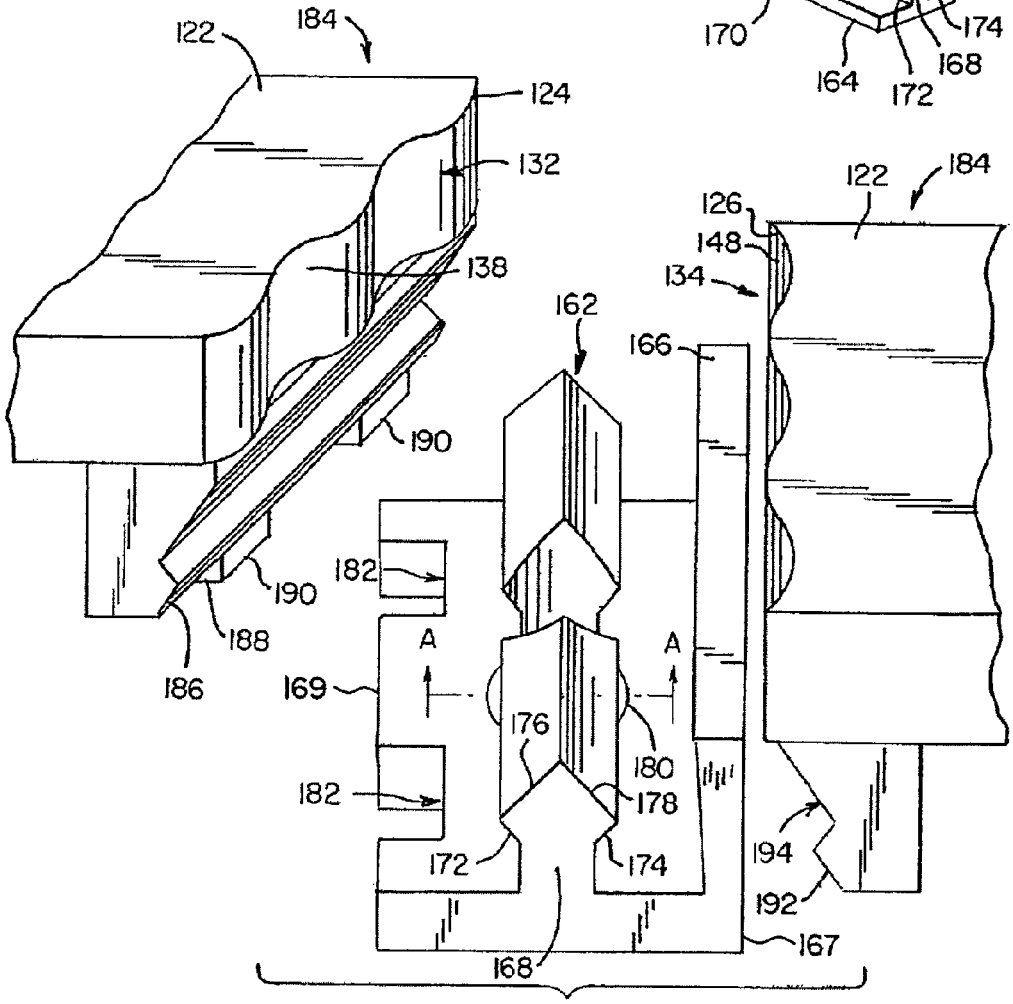
FIG. 6 is a fragmentary perspective view of the lockup device of FIG. 5 along with opposite axial ends of a cutting mat suitable for use with the lockup device.

Referring to FIG. 6, the cutting mat 184 suitable for use with the lockup device 162 is illustrated. The cutting mat 184 is similar to the cutting mat 120 discussed above with reference to FIGS. 1-4 differing, for example, in the configuration of the locking members. As such, like structure is represented by like reference numbers. The cutting mat 184 comprises a generally elongate body 122 and includes opposing and complimentary first and second axial edges 124, 126.

The first locking member 132 includes a first aligning surface 186 oriented such that when the first locking member 132 engages the lockup device 162, the first aligning surface 186 engages the first guide surface 176 of the locking wedge 168 to direct and guide the first locking member 132 into an appropriate locked position. The first locking member 132 also includes a first locking recess 188 extending axially therealong such that when the first locking member 132 is in the appropriate locked position with the lockup device 162, the first locking surface 172 and first guide surface 176 of the locking wedge 168 engage the first locking recess 188. If the lockup device 162 includes slots 182, then the first locking member 132 may include corresponding posts 190 projecting therefrom.

The second locking member 134 includes a second aligning surface 192 oriented such that when the second locking member 134 is being snap fitted or otherwise inserted into the lockup device 162, the second aligning surface 192 engages the second guide surface 178 of the locking wedge 168 to direct and guide the second locking member 134 into a locking area defined between the sidewall 166 and the locking wedge 168. The second locking member 134 also includes a second locking recess 194 extending axially along therealong. When the second locking member 134 is appropriately positioned between the sidewall 166 and the locking wedge 168, the second locking surface 176 and second guide surface 178 of the locking wedge 168 engage the second locking recess 194.

According to one embodiment of the present invention, at least a portion of the first face 138 of the first locking member 132 is generally nonlinear. For example, as shown, the first face 138 follows the pattern of the nonlinear first axial edge 124 thus defining a contoured surface profile in a first portion of the first face 138 defined generally between the first axial edge 124 and the first locking recess 188. A second portion of the first face 138 generally including the first locking recess 188 and first aligning surface 186 is generally linear in the axial direction so as to coincide with the lockup device 162. Similarly, the second face 148 of the second locking member 134 is generally nonlinear and follows the pattern of the nonlinear second axial edge 126 thus defining a contoured surface profile in a first portion of the second face 148 defined generally between the second axial edge 126 and the second locking recess 194. A second portion of the second face 148 generally including the second locking recess 194 and second aligning surface 192 is generally linear in the axial direction so as to coincide with the lockup device 162.

Figure 7:
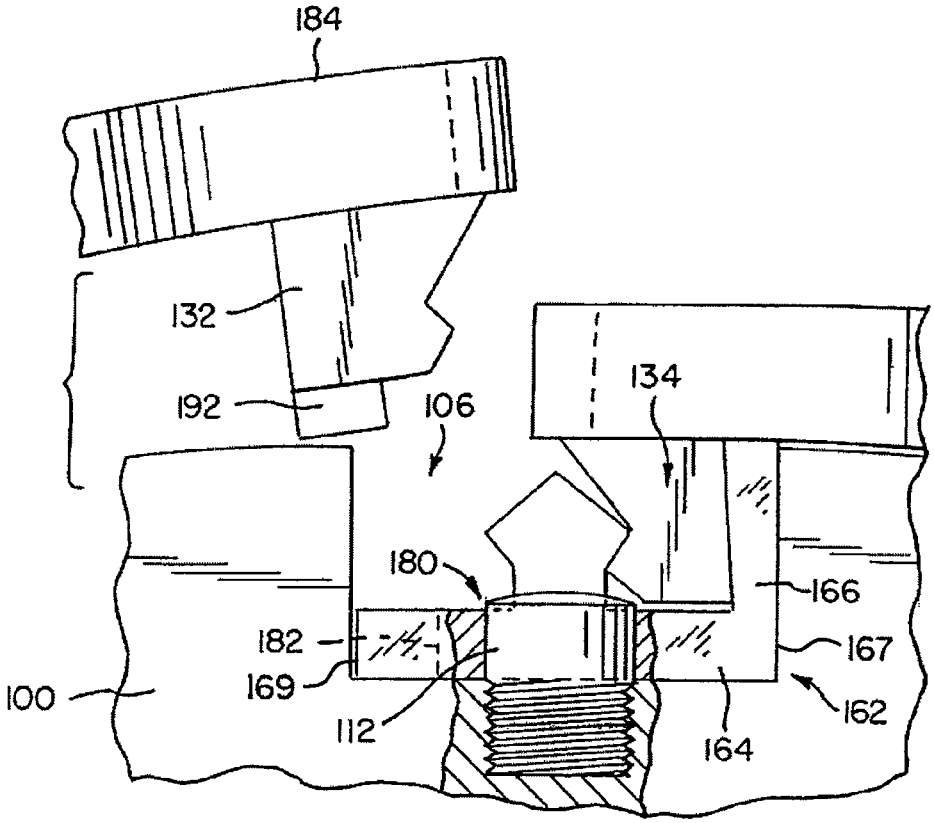
FIG. 7 is a fragmentary side view of the cutting mat and lockup device of FIG. 6 in the process of being installed onto a typical rotary anvil according to an embodiment of the present invention.
Figure 8:
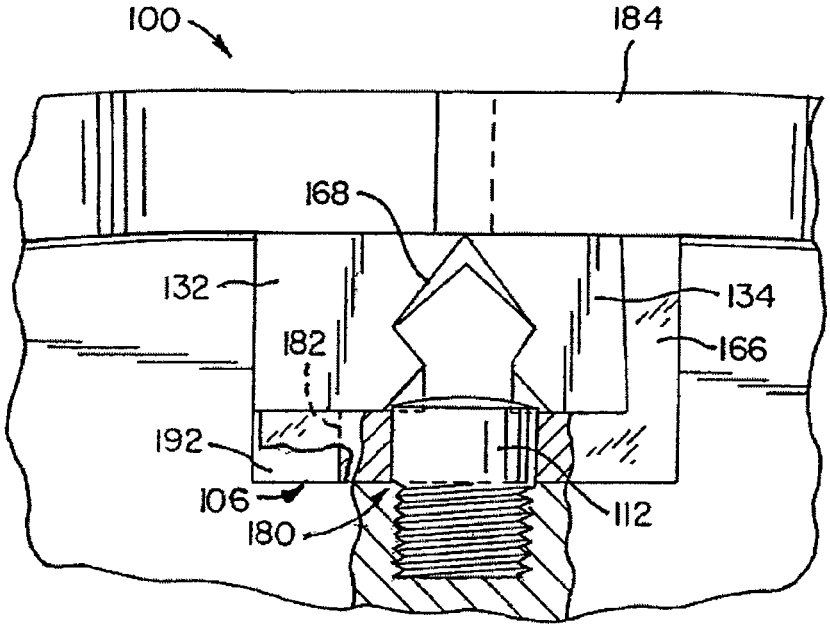
FIG. 8 is a fragmentary side view of the cutting mat and lockup device of FIG. 6 installed on a typical rotary anvil.

One process for installing the cutting mat 184 onto a rotary anvil 100 is shown in FIGS. 7 and 8. Referring initially to FIG. 7, the lockup device 162 is fit into the channel 106 of the rotary anvil 100 such that the base 164 of the lockup device 162 rests on the floor of the channel 106, and the sidewall 166 lies juxtaposed with a wall of the channel 106. The cutting mat 184 is partially installed on the lockup device 162 by press fitting or snap fitting the second locking member 134 into the locking area between the sidewall 166 and the locking wedge 168. This may be accomplished either before or after installing the lockup device 162 into the channel 106 of the rotary anvil 100. When the lockup device is properly seated in the channel 106, the pin 112 in the channel 106 suitably aligns over the pin receptacle 180. Because the cutting mat 184 is frictionally held to the rotary anvil 100, the width of the base 164 of the lockup device 162 need not form an interference or compressive fit with the width of the channel 106.

Referring to FIG. 8, the first locking member 132 is inserted into the channel 106 between the locking wedge 168 of the lockup device 162 and a sidewall of the channel 106. There is only one sidewall 166 on the lockup device 162. This allows the lockup device 162 to be easily and quickly installed and removed from the channel 106 of the rotary anvil 100. Therefore, the wall of the channel 106 itself serves as a holding surface to secure the first locking member 132 to the rotary anvil 100. Further, when the first locking member 132 is released from the channel 106, and the cutting mat is unwrapped, the sidewall 166 and locking wedge 168 of the lockup device 162 maintain a secure hold on the second locking member 134 of the cutting mat 184. This allows the lockup device 162 to release from the channel 106 while still attached to the cutting mat 184.

It is preferable that the first locking member 132 is generally thicker than the second locking member 134 to provide a large surface to snap into place while the cutting mat 184 is under pressure from being wrapped around the rotary anvil 100. Also, the cutting mat 184 and lockup device 162 are securely held to the rotary anvil 100 by the combination of frictional forces derived from fitting the lockup device 162 into the channel 106, from the engagement of the pin 112 with the pin receptacle 180, and from the frictional forces of the first and second locking members 132, 134.

The pin 112 creates a physical link between a properly installed cutting mat and the cylinder 100 to provide an interconnection therebetween. However, because no bolts are used to secure the cutting mats to the anvil, the present invention enjoys the speed of installation and quick cutting mat changeover of a boltless design. Moreover, the physical link created by the pin 112 can provide improved holding of the cutting mat to the cylinder 100 for example, during use where the edges of the channel walls are beveled due to wear or modification. Referring to the Figures generally, during use, several cutting mats may be axially aligned on the rotary anvil 100. This is best illustrated in FIG. 1 of U.S. patent application Ser. No. 09/881,943, which was previously incorporated herein by reference. Should excess wear be evidenced on one of several cutting mats, there is now, no longer a need to grind down or rotate the entire set of cutting mats 114. A user may simply release the worn cutting mat 120 from the channel 106 of the rotary anvil, and replace or rotate the cutting mat 120/cutting mat 184 and lockup device 162 end for end, and reposition it back in place without disturbing the remainder of the cutting mats 114.

Further, the nonlinear seams created when cutting mats according to various embodiments of the present invention are used on a rotary anvil may provide increased cutting mat stability. For example, the nonlinear axial edges tend to prevent lateral slippage (movement of the cutting mat in the axial direction). The nonlinear seams also allow the cutting mat 120 to align more easily on the rotary anvil, such as with adjacent cutting mats.

Referring generally to FIG. 1, according to an embodiment of the present invention, two pins 112 are provided, one on each of the outermost edges of the anvil 100. A first cutting mat is installed over the first pin and a second cutting mat is installed over the second pin. Cutting mats installed between the pins 112 need not necessarily be provided with pins of their own because the outer most cutting mats will provide sufficient lateral stability to support the inner cutting mats. Alternatively, each cutting mat installed on the anvil 100 may include a pin 112.

Having described the invention in detail and by reference to preferred embodiments thereof, it will be apparent that modifications and variations are possible without departing from the scope of the invention defined in the appended claims.

What is claimed is:

The invention claimed is:

1. A cutting mat and lockup system for use with a rotary anvil comprising:

a cutting mat having:

a generally elongate body;

opposing, complimentary and nonlinear first and second axial edges;

a first end portion proximate to said first axial edge having a first locking member comprising a first face, at least a portion of which is nonlinear in an axial direction;

a second end portion proximate to said second axial edge having a second locking member comprising a second face that is generally complimentary to said first face; and a lockup device comprising:

a base having first and second axial edges, and a pin receptacle dimensioned to position over a pin projecting from a channel of said rotary anvil;

a sidewall projecting from said first axial edge of said base; and, a locking wedge projecting from said base defining a first locking area between said sidewall and said locking wedge and a second locking area between said locking wedge and said second axial edge of said base; wherein:

said lockup device is installable into a channel of a rotary anvil such that said in receptacle is received by a in protruding from said channel and said cutting mat is installable into said lockup device such that said first locking member is received by said first locking area, said second locking member is received by said second locking area, said first and second faces abut in mating relationship and said first and second axial edges define a nonlinear seam therebetween; and wherein said base of said lockup device further comprises a slot and said second locking member comprises a post projecting therefrom, said slot and post oriented such that when said cutting mat and said lockup device are installed in said channel of said rotary anvil, said post seats down into said slot.

2. The cutting mat and lockup system according to claim 1, wherein said slot extends inwardly from said second axial edge of said base.

3. The cutting mat and lockup system according to claim 1, wherein said slot extends entirely through said base.

4. A cutting mat and lockup system for use with a rotary anvil comprising:

a cutting mat having:

a generally elongate body;

opposing, complimentary and nonlinear first and second axial edges;

a first end portion proximate to said first axial edge having a first locking member comprising a first face, at least a portion of which is nonlinear in an axial direction;

a second end portion proximate to said second axial edge having a second locking member comprising a second face that is generally complimentary to said first face; and a lockup device comprising:

a base having first and second axial edges, and a pin receptacle dimensioned to position over a pin projecting from a channel of said rotary anvil;

a sidewall projecting from said first axial edge of said base; and, a locking wedge projecting from said base defining a first locking area between said sidewall and said locking wedge and a second locking area between said locking wedge and said second axial edge of said base; wherein:

said lockup device is installable into a channel of a rotary anvil such that said in receptacle is received by a in protruding from said channel and said cutting mat is installable into said lockup device such that said first locking member is received by said first locking area, said second locking member is received by said second locking area, said first and second faces abut in mating relationship and said first and second axial edges define a nonlinear seam therebetween; and wherein said base of said lockup device further comprises a plurality of slots and said second locking member comprises a corresponding plurality of posts projecting therefrom, said plurality of slots and said plurality of posts oriented such that when said cutting mat and lockup device are installed in said channel of said rotary anvil, each of said plurality of posts seats down in a corresponding one of said plurality of slots.

5. A cutting mat and lockup system for use with a rotary anvil having an axially extending channel along the surface thereof, said cutting mat and lockup system comprising:

a cutting mat having:

a generally elongate body;

opposing, complimentary and nonlinear first and second axial edges;

a first end portion proximate to said first axial edge having a first locking member comprising a first post projecting therefrom, and a first face, at least a portion of which is nonlinear in an axial direction;

a second end portion proximate to said second axial edge having a second locking member comprising a second face that is generally complimentary to said first face; and a lockup device comprising:

a base having first and second axial edges, and a first slot at least partially therethrough, and a pin receptacle dimensioned to position over a pin projecting from a channel of said rotary anvil;

a sidewall projecting from said first axial edge of said base; and, a locking wedge projecting from said base defining a first locking area between said sidewall and said locking wedge and a second locking area between said locking wedge and said second axial edge of said base; wherein:

said lockup device is installable into said channel of said rotary anvil such that said pin receptacle is received by a pin protruding from said channel and said cutting mat is installable into said lockup device such that said first locking member is received by said first locking area, said second locking member is received by said second locking area, said first and second faces abut in mating relationship, said first post on said second locking member of said cutting mat seats down into said first slot of said lockup device, and said first and second axial edges define nonlinear seam therebetween.

6. The cutting mat and lockup system according to claim 5, wherein said first slot in said lockup device is recessed inwardly of said second axial edge of said base.

7. The cutting mat and lockup system according to claim 5, wherein said pin receptacle comprises a through hole in said base of said lockup device.

8. The cutting mat and lockup system according to claim 5, wherein said pin receptacle comprises a cavity in a bottom surface of said base of said lockup device.

9. The cutting mat and lockup system according to claim 5, wherein said base of said lockup device comprises at least one additional slot and said second locking member comprises a corresponding number of additional posts such that when said lockup device and said first and second locking members are positioned within said channel, each post seats down into an associated slot.

* * * * *

UNITED STATES PATENT AND TRADEMARK OFFICE

CERTIFICATE OF CORRECTION

PATENT NO. : 8,590,436 B2
APPLICATION NO. : 11/328346
DATED : November 26, 2013
INVENTOR(S) : John R. Elia et al.

It is certified that error appears in the above-identified patent and that said Letters Patent is hereby corrected as shown below:

In the Claims

Col. 9, Claim 1, Line 46, "anvil such that said in receptacle is received by a in" should read
--anvil such that said pin receptacle is received by a pin--; and Col. 10, Claim 4, Line 25, "anvil such that said in receptacle is received by a in" should read
--anvil such that said pin receptacle is received by a pin--.

Signed and Sealed this
Twenty-first Day of October, 2014

Michelle K. Lee

Michelle K. Lee
*Deputy Director of the United States Patent and Trademark Office*